US010418172B2

(12) United States Patent
Grueso et al.

(10) Patent No.: US 10,418,172 B2
(45) Date of Patent: Sep. 17, 2019

(54) METHODS OF FORMING COILS FOR INDUCTIVE COMPONENTS

(71) Applicant: Astec International Limited, Kowloon (HK)

(72) Inventors: Alfredo Grueso, Teresa (PH); Joven Abella, Binangonan (PH); Roger Mendoza, Cuenca (PH)

(73) Assignee: Astec International Limited, Kwun Tong, Kowloon (HK)

( * ) Notice: Subject to any disclaimer, the term of this patent is extended or adjusted under 35 U.S.C. 154(b) by 0 days.

(21) Appl. No.: 15/371,832

(22) Filed: Dec. 7, 2016

(65) Prior Publication Data

US 2018/0158593 A1 Jun. 7, 2018

(51) Int. Cl.

| | |
|---|---|
| ***H01F 7/06*** | (2006.01) |
| ***H01F 41/061*** | (2016.01) |
| ***H01F 27/28*** | (2006.01) |

(52) U.S. Cl.

CPC ..... *H01F 41/061* (2016.01); *H01F 27/2847* (2013.01); *H01F 27/2866* (2013.01); *H01F 2027/2861* (2013.01)

(58) Field of Classification Search

CPC ..... H01F 27/2823; H01F 41/074

See application file for complete search history.

(56) References Cited

U.S. PATENT DOCUMENTS

| | | | | |
|---|---|---|---|---|
| 4,411,149 | A * | 10/1983 | Delorme | H01L 21/4842 228/15.1 |
| 6,204,745 | B1 | 3/2001 | Liu et al. | |
| 6,577,220 | B2 * | 6/2003 | Liu | H01F 27/2847 336/200 |
| 7,479,863 | B2 | 1/2009 | Kit et al. | |
| 7,982,576 | B2 | 7/2011 | Feng et al. | |
| 8,250,738 | B2 * | 8/2012 | Hasegawa | H02K 3/18 29/596 |
| 8,550,125 | B2 * | 10/2013 | Hattori | H01F 27/2847 140/71 C |
| 9,712,010 | B2 * | 7/2017 | Watanabe | H02K 3/12 |
| 2010/0109831 | A1 | 5/2010 | Podevels et al. | |
| 2016/0225514 | A1 | 8/2016 | Cheng et al. | |

OTHER PUBLICATIONS

BT Coil Co., Ltd., http://www.btcoil.com/product.php?cid=62, 2002-2015 (2 pages).

* cited by examiner

*Primary Examiner* — Paul D Kim
(74) *Attorney, Agent, or Firm* — Harness, Dickey & Pierce, P.L.C.

(57) ABSTRACT

A method of forming a coil for an inductive component includes bending a conductor into a figure 8 configuration. The figure 8 configuration has opposite first and second ends, a first substantially rounded portion, and a second substantially rounded portion. Each of the first and second substantially rounded portions terminates at one of the first and second ends. The method further includes folding the figure 8 configuration so the first substantially rounded portion overlies the second substantially rounded portion. Other example methods of forming coils for inductive components and other example coils are also disclosed.

14 Claims, 7 Drawing Sheets

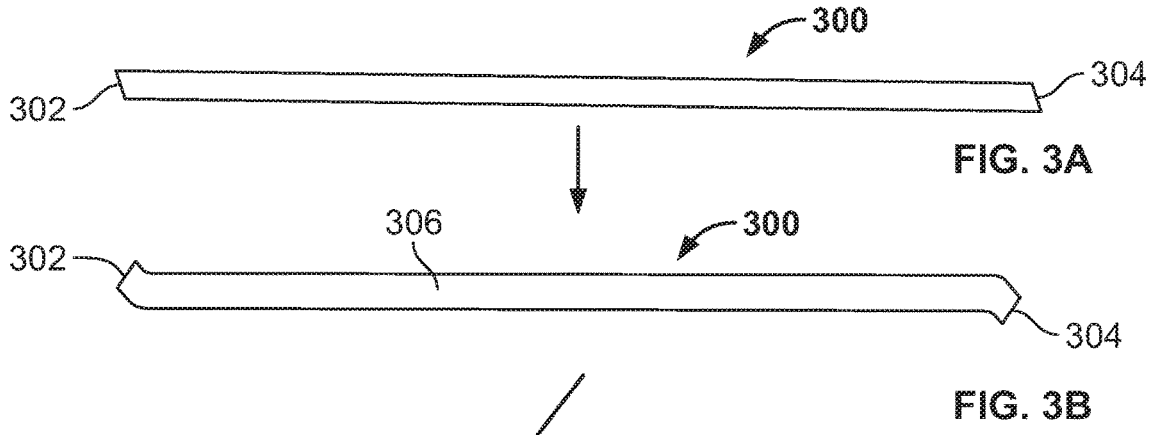
FIG. 3A
FIG. 3B
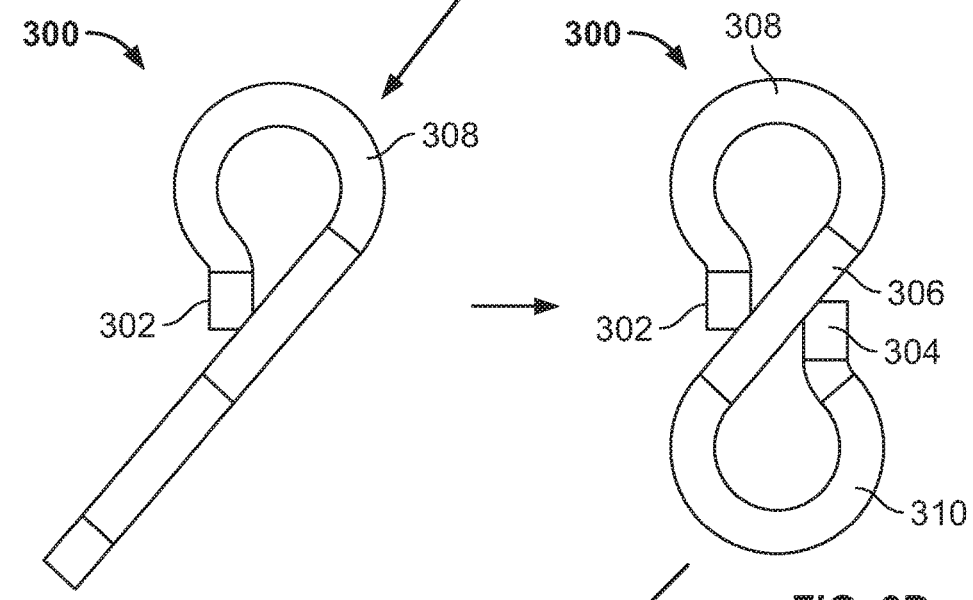
FIG. 3C
FIG. 3D
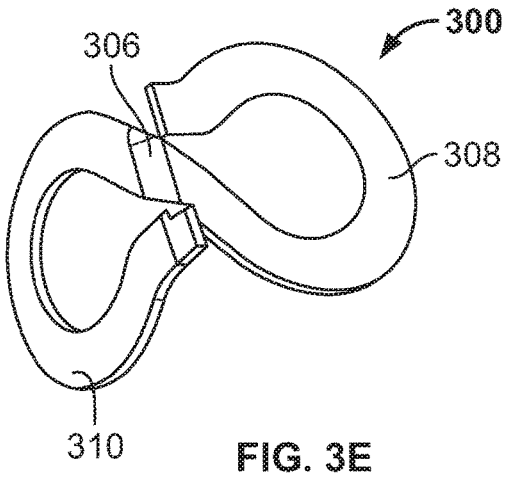
FIG. 3E

METHODS OF FORMING COILS FOR INDUCTIVE COMPONENTS

FIELD

The present disclosure relates to methods of forming coils for inductive components.

BACKGROUND

This section provides background information related to the present disclosure which is not necessarily prior art.

Inductors and transformers commonly include one or more coils. Sometimes, these coils are formed by stamping or photochemical etching one or more pieces of conductive material. In some instances, the coils formed by stamping can include rectangular portions including sharp edges. This coil configuration is commonly called a bus bar coil design.

SUMMARY

This section provides a general summary of the disclosure, and is not a comprehensive disclosure of its full scope or all of its features.

According to one aspect of the present disclosure, a method of forming a coil for an inductive component includes bending a conductor into a figure 8 configuration. The figure 8 configuration has opposite first and second ends, a first substantially rounded portion, and a second substantially rounded portion. Each of the first and second substantially rounded portions terminates at one of the first and second ends. The method further includes folding the figure 8 configuration so the first substantially rounded portion overlies the second substantially rounded portion.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 3A is a top view of a substantially flat elongated conductor used to form a coil according to yet another example embodiment.

FIG. 3B is a top view of the conductor of FIG. 3A having bent ends.

FIG. 3C is a top view of the conductor of FIG. 3B having one substantially rounded portion.

FIG. 3D is a top view of the conductor of FIG. 3C having two substantially rounded portions.

FIG. 3E is an isometric view of the conductor of FIG. 3D being folded to form a two-turn coil.

Corresponding reference numerals indicate corresponding parts or features throughout the several views of the drawings.

DETAILED DESCRIPTION

Figure 1:
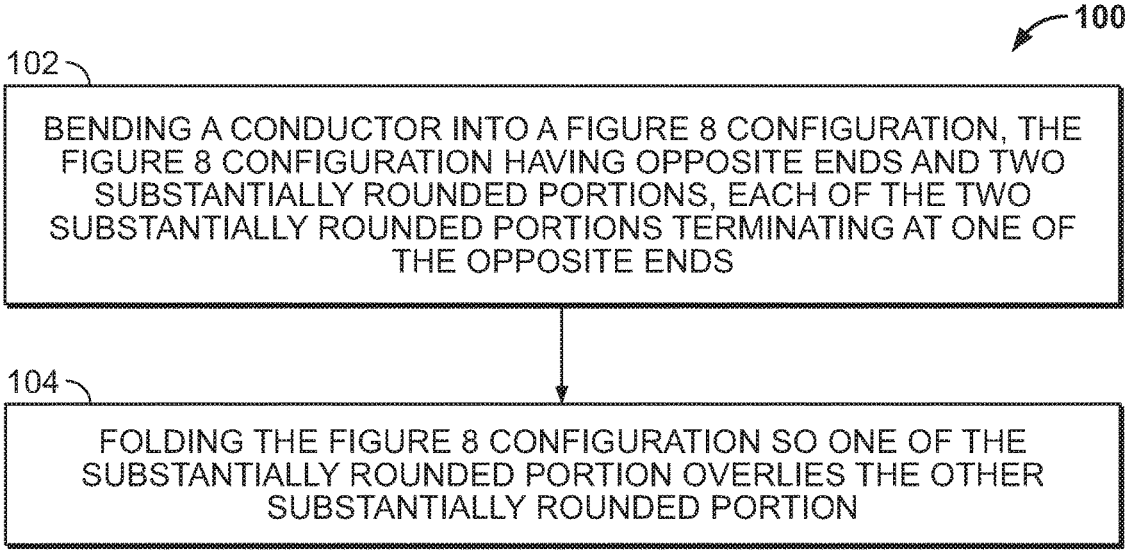
FIG. 1 is a flow diagram for a method of forming a coil in which the method includes bending a conductor into a figure 8 configuration and then folding the figure 8 configuration, according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A method of forming a coil for an inductive component according to one example embodiment of the present disclosure is illustrated in FIG. 1 and indicated generally by reference number 100. As shown in FIG. 1, the method 100 includes bending a conductor into a figure 8 configuration, in block 102. The figure 8 configuration has opposite ends and substantially rounded portions. Each of the substantially rounded portions terminates at one of the ends. The method 100 further includes folding the figure 8 configuration so one substantially rounded portion overlies the other substantially rounded portion, in block 104.

By forming one or more coils with the method 100 of FIG. 1 (and/or other methods disclosed herein), the coils may experience less waste material than conventional coils. For example, the coils can be formed without stamping, photochemical etching, etc. which commonly produce waste material. Therefore, the coils disclosed herein may be produced with less waste material than conventional coils, and in turn reduce costs, manufacturing time, etc. compared to conventional methods.

Additionally, coils formed by the methods disclosed herein may include significantly reduced (and sometimes no) sharp edges such as burrs, etc. compared to coils produced by conventional methods (e.g., stamping). For example, stamping and other similar conventional coil forming methods produce coils having burrs. In contrast, the coils disclosed herein may be formed without burrs, as further explained below. Burrs and other sharp edges may damage insulation of adjacent coil(s) which in turn can cause high potential (hipot) failures. As such, eliminating sharp edges on the coils can eliminate high potential (hipot) failures. Further, the reduction (and many times the elimination) of sharp edges on the coils may also reduce the need for ancillary material such as insulation, etc. used to cover burrs, the need for additional process steps (e.g., grinding, etc.) commonly employed to reduce burrs, etc. Therefore, production costs for the subject coils may be reduced compared to conventional coils.

Figure 6:
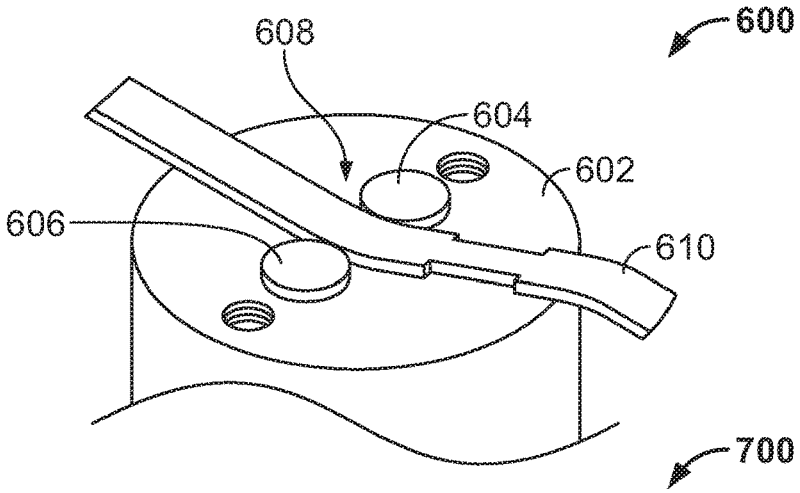
FIG. 6 is an isometric view of a device used for bending, folding, etc. a conductor into a desired shape according to another example embodiment.
Figure 7:
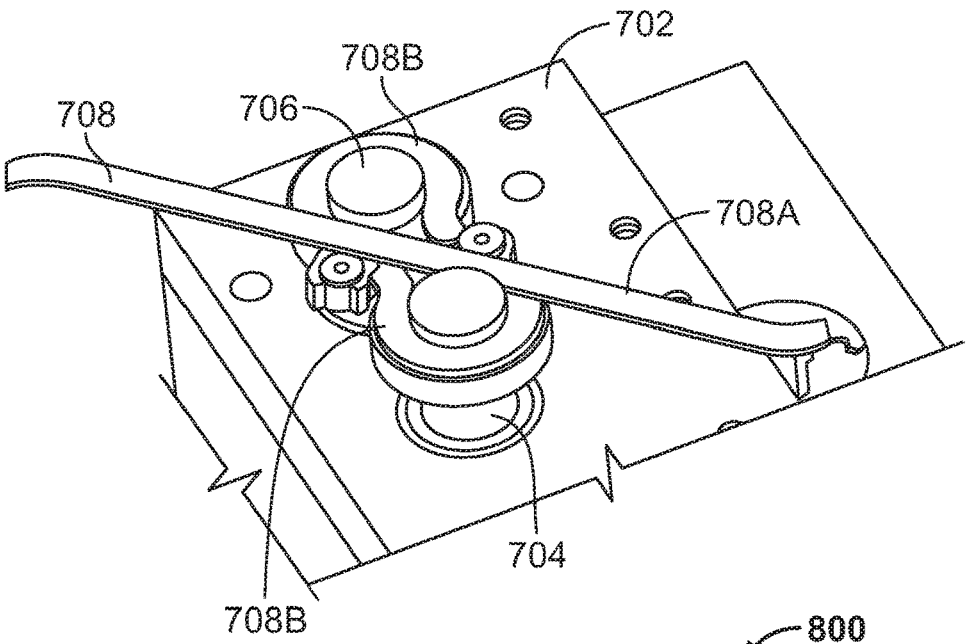
FIG. 7 is an isometric view of a device used for bending, folding, etc. a conductor into a desired shape according to yet another example embodiment.
Figure 8:
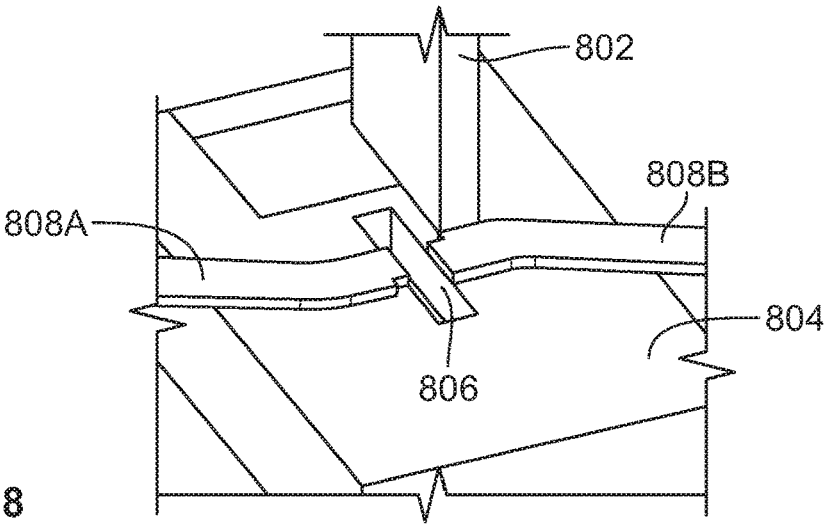
FIG. 8 is an isometric view of a device used for cutting, etc. a conductor into a desired length according to another example embodiment.

The bending step (block 102 of FIG. 1) and the folding step (block 104 of FIG. 1) can be completed manually. Alternatively, the bending step and the folding step can be automated. For example, FIGS. 6-8 illustrate devices (e.g. machines such as auto-winding machines, etc.) that can bend, fold, cut, etc. the conductor into one or more particular shapes according to pre-programmed data, user input, etc. In particular, FIGS. 6 and 7 illustrate devices 600, 700 each including a platform 602, 702 and shafts 604, 606, 704, 706 extending from the platform 602, 702. One or both shafts 604, 606, 704, 706 of each device can rotate or remain stationary, if desired.

As shown, each set of shafts 604, 606, 704, 706 define one or more openings for receiving a conductor. For example, the shafts 604, 606 of FIG. 6 define an opening 608 for receiving a conductor 610. The conductor 610 can be bent as desired when placed between the shafts 604, 606.

The shafts 704, 706 of FIG. 7 define various openings for receiving a conductor 708. For example, similar to the conductor 610 of FIG. 6, the conductor 708 of FIG. 7 can be bent as desired when placed between the shafts 704, 706. In some embodiments, and as shown in FIG. 7, the conductor 708 can initially be placed adjacent the shafts 704, 706 as represented by reference number 708A. The conductor 708 can then be bent around the shafts 704, 706 to form two substantially rounded portions, as explained above. This is represented by reference number 708B.

FIG. 8 illustrates another device 800 that can be used to cut a conductor. The device 800 includes a press 802 and a platform 804 defining an opening 806 for receiving the press 802. A conductor can be placed on the platform 804 between the opening 806 and the press 802. When desired, the press 802 can be forced downward through the conductor and into the opening 806 to cut the conductor into two portions (shown as conductor portions 808A and 808B in FIG. 8).

Referring back to FIG. 1, the conductor (and/or other conductors disclosed herein) may be cut to a defined length prior to bending the conductor into the figure 8 configuration. For example, the conductor can be cut to a particular length depending on customer specifications, electrical parameters, size, etc. In such examples, further cutting on the conductor may not be necessary.

In other embodiments, the conductor may be cut (e.g., to a particular length, trimmed, etc.) to create the opposite ends after bending the conductor, as explained above. For example, the conductor can be cut after bending the conductor into the figure 8 configuration, after folding the figure 8 configuration, etc.

Figure 2:
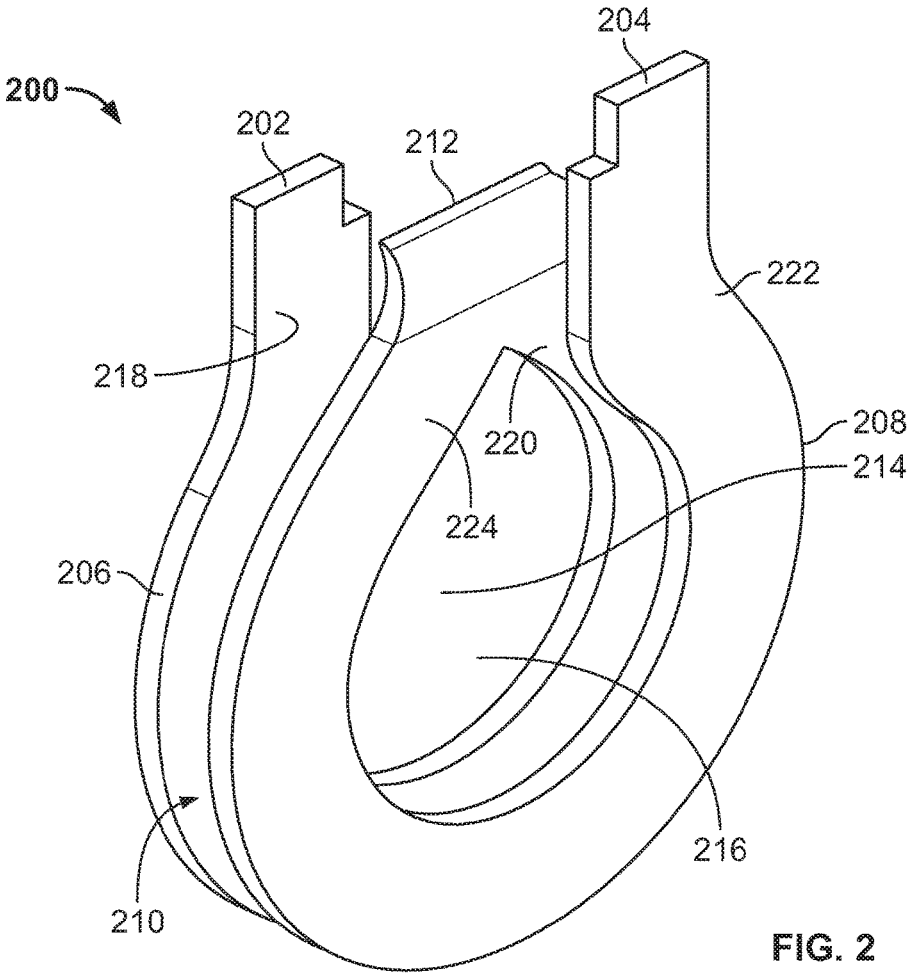
FIG. 2 is an isometric view of a two-turn coil formed by the method of FIG. 1, according to another example embodiment.

The method 100 of FIG. 1 can produce various different coils having a folded figure 8 configuration. FIG. 2 illustrates one example coil 200 that may be formed from the method 100 of FIG. 1, and used in an inductive component such as an inductor or a transformer. As shown in FIG. 2, the coil 200 includes two ends 202, 204, and two substantially rounded portions 206, 208 each terminating at one of the ends 202, 204, respectively. The rounded portions 206, 208 and ends 202, 204 create a two-turn coil.

In the particular example of FIG. 2, a gap 210 is created between the substantially rounded portions 206, 208 after the portions 206, 208 are folded. This gap 210 can be used to receive another coil of the inductive component. For example, the inductive component may include a wire coil positioned within the gap 210 of the coil 200.

As shown in FIG. 2, the two substantially rounded portions 206, 208 each include two ends. For example, the rounded portion 206 includes ends 218, 220 and the rounded portion 208 includes ends 222, 224. The ends 218, 222 of the substantially rounded portions 206, 208 terminate at the coil ends 202, 204, respectively, as explained above. The other ends 220, 224 of the substantially rounded portion 206, 208 are united at a crossover portion 212. In the particular embodiment of FIG. 2, the crossover portion 212 acts as a midpoint between the two-turn coil 200.

In the particular example embodiment of FIG. 2, the crossover portion 212 acts as a backstop for one or more coils inserted into the gap 210. For example, if other coil(s) such as one or more wire coils are positioned within the gap 210 as explained above, a portion of those coil(s) can contact the crossover portion 212.

In such examples, the other coil(s) can be substantially aligned with the rounded portions 206, 208 such that little (and sometimes no) part of the coil(s) extend beyond the perimeter of the rounded portions 206, 208. In other words, when the other coil(s) are placed within the gap 210, the coil(s) may have little to no offset relative to the rounded portions 206, 208. As such, the coil(s) may not extend beyond the rounded portions 206, 208 and therefore not interfere with a core assembly (as in the example explained below) as is common with conventional methods. This little to no offset may be due to, for example, the width of the gap 210 adjacent the crossover portion 212, the location of the crossover portion 212 (e.g., on or near the outer edge of the rounded portions 206, 208, etc.), the size of the other coil(s), etc.

As shown in FIG. 2, the substantially rounded portions 206, 208 each define an opening 214, 216, respectively. The openings 214, 216 may be substantially aligned after the figure 8 configuration is folded (e.g., when one of the substantially rounded portion 206 overlies the other substantially rounded portion 208), as explained above. In such examples, a ferrite core and/or another suitable core may be inserted into, formed within, etc. the openings 214, 216 and opening(s) of the other coil(s) (if employed).

In the particular example of FIG. 2, the ends 202, 204 extend in substantially parallel planes. For example, the figure 8 configuration formed by the substantially rounded portions 206, 208 may be folded to ensure the ends 202, 204 extend in separate but parallel planes relative to each other. Alternatively, the ends 202, 204 may extend in planes that are not parallel to each other. For example, one end (e.g., the end 202) may extend at a particular angle relative to the other end (e.g., the end 204) such that the ends 202, 204 extend in nonparallel planes, if desired.

Additionally, and as shown in FIG. 2, the ends 202, 204 are located on opposing sides of the coil 200 after the figure 8 configuration is folded. In other embodiments, the conductor (e.g., the ends 202, 204, etc.) may be manipulated to force the ends 202, 204 to extend from the same side of the coil 200 if desired.

In some embodiments, the coils disclosed herein can be formed of two or more conductors attached (e.g., welded, bonded, etc.) together. In other embodiments, the coils can be formed from one continuous conductor. FIGS. 3A-3F (collectively FIG. 3) illustrate one example process of forming a two-turn coil from one continuous conductor. If desired, the conductor can be fed into the devices 600, 700, 800 of FIGS. 6-8 and/or another suitable device to allow the devices to cut, bend, fold, etc. the conductor into a desired coil shape.

For example, the process of FIG. 3 begins with a substantially flat elongated conductor 300 having opposing ends 302, 304, as shown in FIG. 3A. The conductor 300 can be a portion of a conductor spool, precut to a defined length at this time, and/or cut (e.g., trimmed, etc.) at another point in the process (e.g., after the ends 302, 304 are bent as explained below). Additionally, and as shown in FIG. 3A, the conductor 300 extends in a single plane.

If desired, one or both ends 302, 304 of the conductor 300 can be bent. As shown in FIG. 3B, both ends 302, 304 are bent such that the ends are offset relative to a central portion 306 of the conductor 300. For example, the ends 302, 304 of the conductor 300 of FIG. 3A (extending a single plane) are bent such that end portions of the conductor 300 extend diagonally away from the central portion in opposing directions. This ensures the ends 302, 304 do not touch, scrub, scratch, etc. the conductor 300 when the conductor 300 is further bent, as explained below. This bending step can occur before and/or after the conductor 300 is bent into a figure 8 configuration, the figure 8 configuration is folded, etc., as further explained below.

Next, a portion of the conductor 300 can be bent into a substantially rounded portion. For example, and as shown in FIG. 3C, a portion of the conductor 300 is bent into a substantially rounded portion 308. In this particular example, the portion of the conductor 300 adjacent the end 302 is bent in a circular fashion to form the rounded portion 308.

At the same time (and/or at a later time), another portion of the conductor 300 can be bent into another substantially rounded portion. For example, and as shown in FIG. 3D, the conductor 300 is bent into substantially rounded portion 310. Similar to forming the rounded portion 308, the portion of the conductor 300 adjacent the end 304 is bent in a circular fashion to form the substantially rounded portion 310. This forms the figure 8 configuration, as shown in FIG. 3D and as explained above.

In the particular example of FIG. 3, the conductor 300 is bent to form the rounded portions 306, 308 such that the ends 302, 304 are on opposing sides of the bent conductor 300. This is accomplished by bending the conductor 300 in opposite directions to form the rounded portions 306, 308.

As shown best in FIG. 3D, the central portion 306 of the conductor 300 extends diagonally between the substantially rounded portion 308 and the substantially rounded portion 310 (and/or between the ends 302, 304). For example, the conductor 300 is bent such that the central portion 306 extends diagonally from one side of the figure 8 configuration to an opposing side of the figure 8 configuration.

In other embodiments, the conductor 300 can be bent so that the central portion 306 extends substantially vertical between the rounded portions 308, 310. In such cases, the bent conductor 300 having a substantially vertical portion the rounded portions 308, 310 forms a figure 8 configuration.

After the substantially rounded portions 308, 310 are formed in FIGS. 3C and 3D, the conductor 300 is folded at the central portion 306 as shown in FIG. 3E. This allows the substantially rounded portion 308 to overlie the substantially rounded portion 310, as explained above. The conductor 300 can be folded until a desired coil (e.g., the coil 200 of FIG. 2, etc.) is formed.

Figure 4:
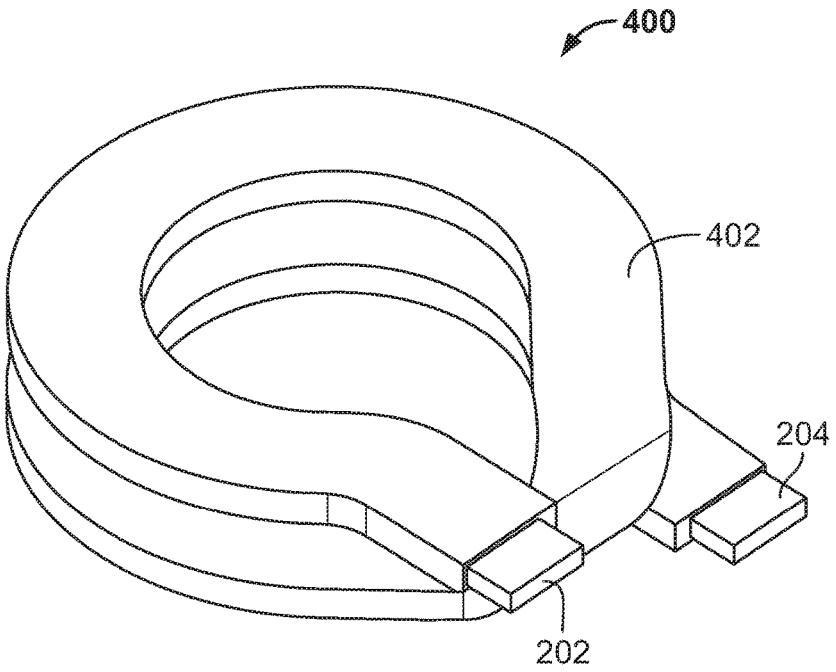
FIG. 4 is an isometric view of a two-turn coil having an insulative material according to another example embodiment.

In some embodiments, the coils disclosed herein may include insulation covering at least a portion of the conductor. For example, FIG. 4 illustrates a coil 400 substantially similar to the coil 200 of FIG. 2. The coil 400 of FIG. 4, however, includes an insulative material 402 substantially covering the conductor which forms the coil 400. The conductor of the coil 400 can be substantially covered with the insulative material 402 before or after the ends 202, 204 of the conductor are optionally bent, the conductor is bent into a figure 8 configuration, the figure 8 configuration is folded to form the coil 400, etc.

Although FIG. 4 illustrates the coil 400 as being substantially covered with the insulative material 402, it should be apparent to those skilled in the art that some portions of the coil 400 may not include insulation if desired.

The insulative material 402 may include any suitable insulative material including, for example, a plastic material (e.g., polyvinyl chloride (PVC), polyethylene (PE), polypropylene (PP), etc.), a rubber material (e.g., neoprene, silicone, etc.), etc.

The methods disclosed herein can form coil(s) having two or more turns. For example, and as explained above, a conductor can be bent and folded to form two-turn coils, as shown in FIGS. 2-4. In other embodiments, the methods can form coil(s) having three or more turns. For example, FIGS. 5A-F each illustrate a coil 500, 502, 504, 506 having either three turns or four turns. At least a portion of each coil 500, 502, 504, 506 of FIGS. 5A-F includes a figure 8 configuration prior to when the conductor forming the coil is folded.

Figure 5A:
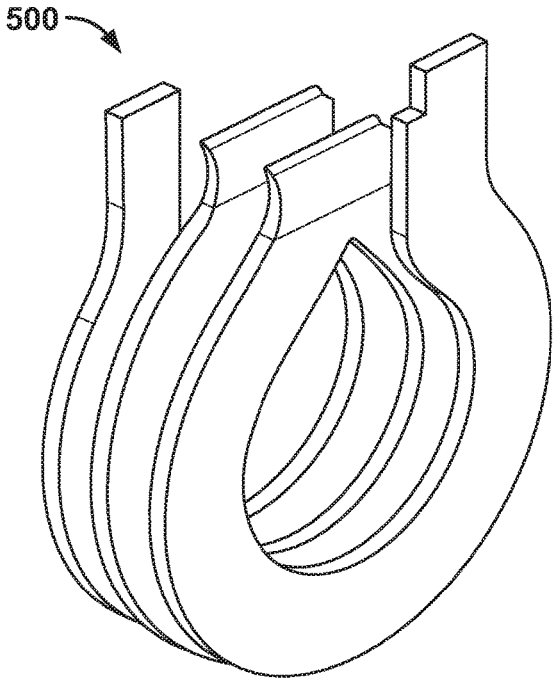
FIG. 5A is an isometric view of a three-turn coil having two gaps, and that is formed by the method of FIG. 1, according to yet another example embodiment.

The coil 500 of FIG. 5A is substantially similar to the coil 200 of FIG. 2, but with three turns. Likewise, the coil 502 of FIG. 5B is substantially similar to the coil 200 of FIG. 2, but with four turns.

Figure 5B:
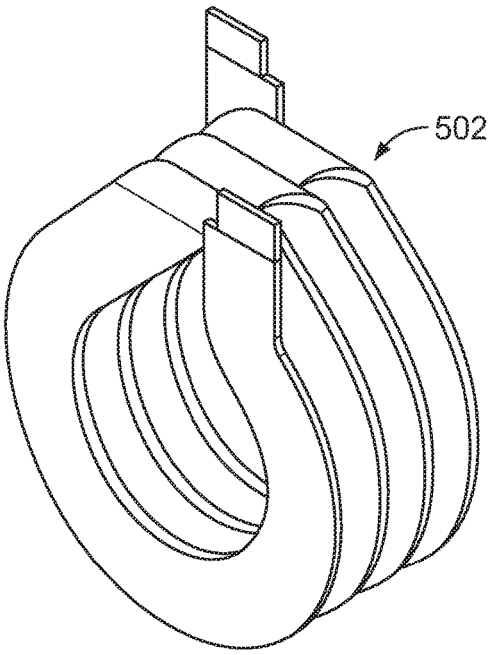
FIG. 5B is an isometric view of a four-turn coil having three gaps, and that is formed by the method of FIG. 1, according to another example embodiment.
Figure 5C:
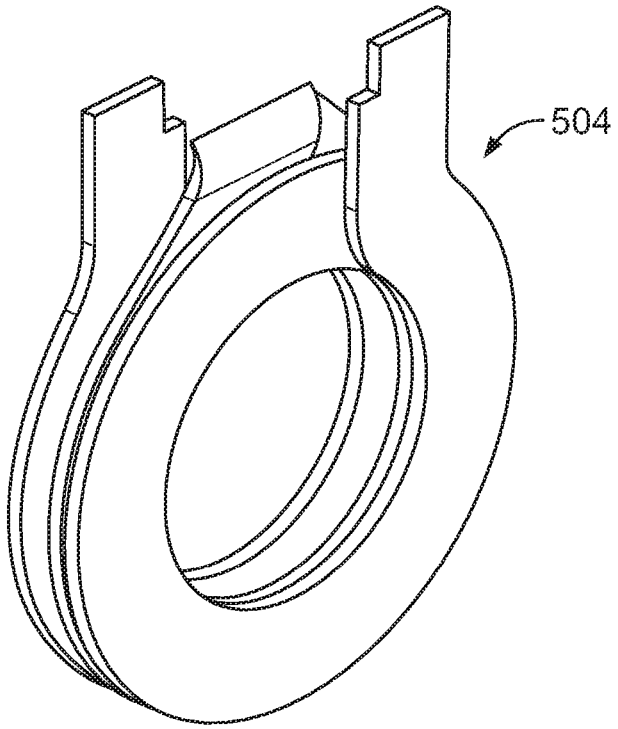
FIG. 5C is an isometric view of a three-turn coil having one gap, and that is formed by the method of FIG. 1, according to yet another example embodiment.
Figure 5D:
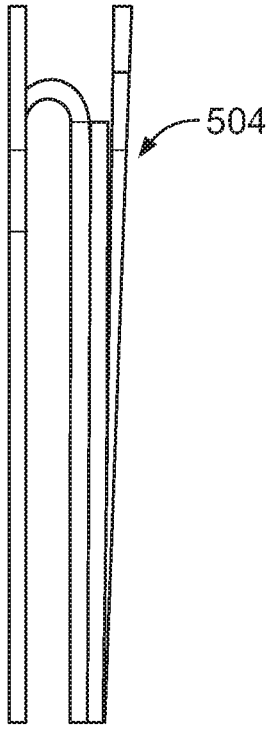
FIG. 5D is a side view of the three-turn coil of FIG. 5C.

The coil 504 of FIGS. 5C-D is substantially similar to the three-turn coil 500 of FIG. 5A, but with two of the three turns positioned approximate to each other. In some cases, the two approximate turns may be in contact if proper suitable insulative is employed, as explained above. As such, and as best shown in FIG. 5D, the coil 504 includes one gap for receiving another coil, etc. (as explained above), whereas the coil 500 of FIG. 5A includes two such gaps.

Figure 5E:
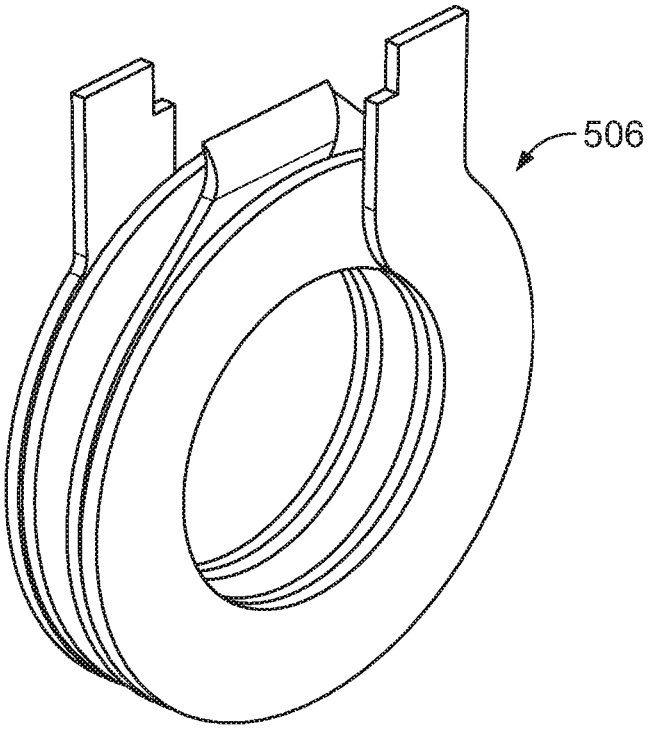
FIG. 5E is an isometric view of a four-turn coil having one gap, and that is formed by the method of FIG. 1, according to another example embodiment.
Figure 5F:
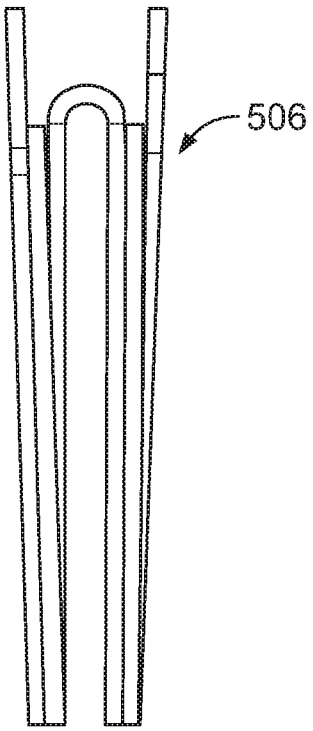
FIG. 5F is a side view of the four-turn coil of FIG. 5E.

The coil 506 of FIGS. 5E-F is substantially similar to the four-turn coil 502 of FIG. 5B, but with the outer turns positioned approximate to (and some cases, in contact with) the inner turns. As such, and as best shown in FIG. 5F, the coil 506 includes one gap for receiving another coil, etc., whereas the coil 502 of FIG. 5B includes three such gaps. Additionally, the coils 504, 506 of FIGS. 5C-F have a narrower profile (e.g., width) than compared to the coils 500, 502 of FIGS. 5A-B.

The coils disclosed herein may be employed in various inductive components such as one or more inductors (e.g., coupled inductors, etc.), transformers (e.g., quasi-planar transformers, etc.), etc. The inductive components can be used in various applications including, for example, AC-DC power converters, DC-DC power converters, etc.

Figure 9:
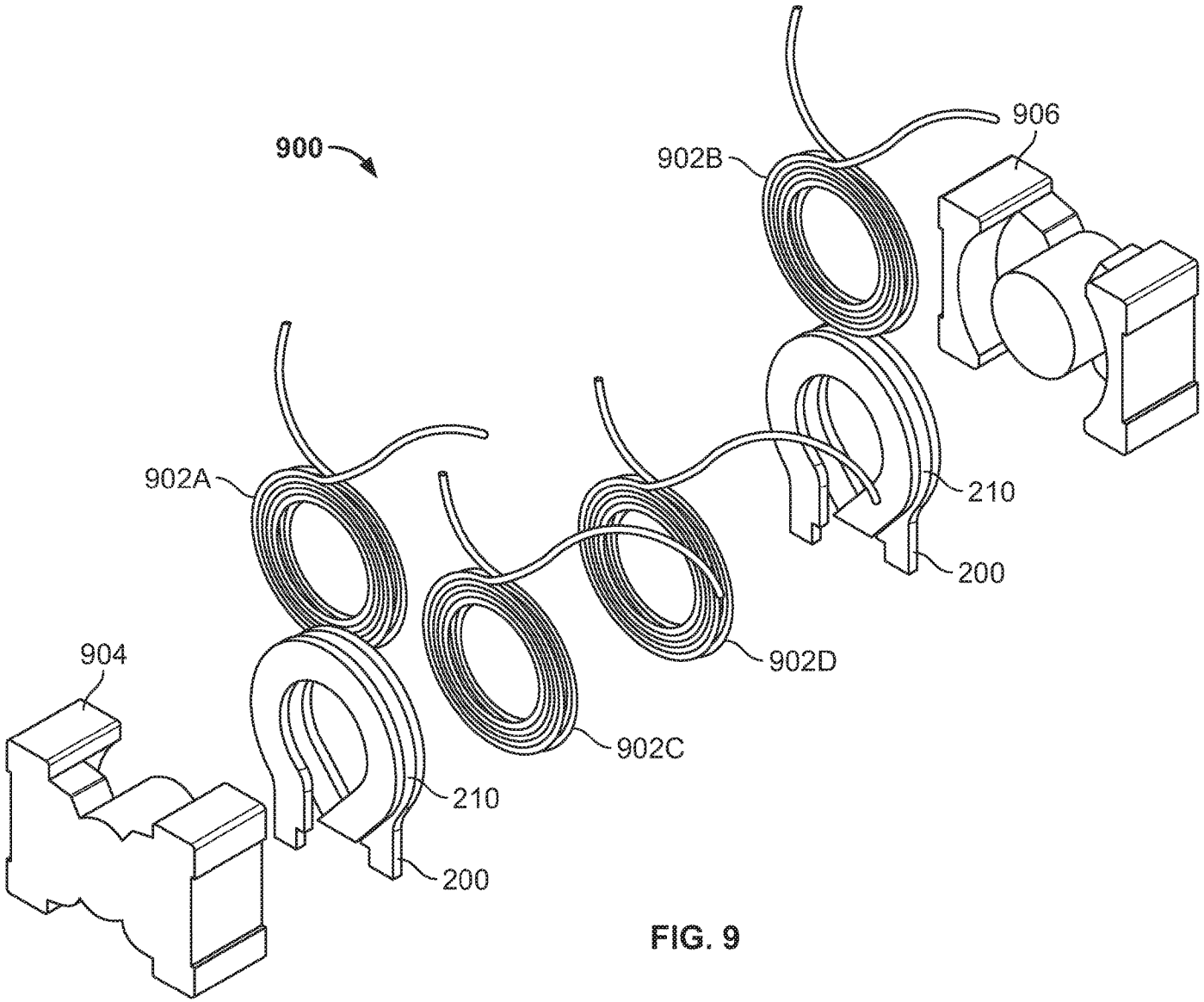
FIG. 9 is an isometric view of an interleaved transformer including two coils of FIG. 2, according to yet another example embodiment.

For example, FIG. 9 illustrates an interleaved transformer 900 including two coils 200 of FIG. 2, coils 902A-D (collectively the coils 902) positioned within and adjacent to the coils 200, and two planar core sections 904, 906 positioned adjacent to the coils 200, 902. As shown, the coils 902A, 902B are inserted into the gaps 210 of the coils 200, as explained above. When the coils 902A-B are inserted (e.g., fully inserted) into the gaps 210 of the coils 200, the coils 902A-B substantially align with rounded portions of the coils 200 such that little (and sometimes no) part of the coils 902A-B extend beyond the perimeter of the coils 200, as explained above.

In the particular example of FIG. 9, the coils 200 are secondary windings of the interleaved transformer 900 and the coils 902A-D can be primary windings, auxiliary windings, etc. of the interleaved transformer 900. The coils 902 may include self-bonding triple insulated wires and/or another suitable wire. Additionally, the coils 902 may have at least some flexibility to allow user(s), machine(s), etc. to manipulate the coils when inserting the coils into the gaps 210.

In the some examples, the interleaved transformer 900 including the coils 200 can achieve an efficiency of up to about 90.94% and a power density greater than 1,000 W/in$^3$, which exceeds a typical target power density of about 50 W/in$^3$. Additionally, the coils can improve the radiated electromagnetic interference (EMI) performance of the transformer 900 compared to conventional coils.

The conductors disclosed herein may be formed of any suitable material. For example, the conductors may be formed of copper (including copper alloys), aluminum (including aluminum alloys), etc.

Additionally, the conductors (and therefore the coils formed from the conductors) may be substantially rigid when the conductors are not being bent, folded, etc. as explained above. As such, the conductors can be employed without the conductors bunching, twisting, etc. as is typical with known heavy gauge conductors (e.g., wires, etc.).

Figure 10A:
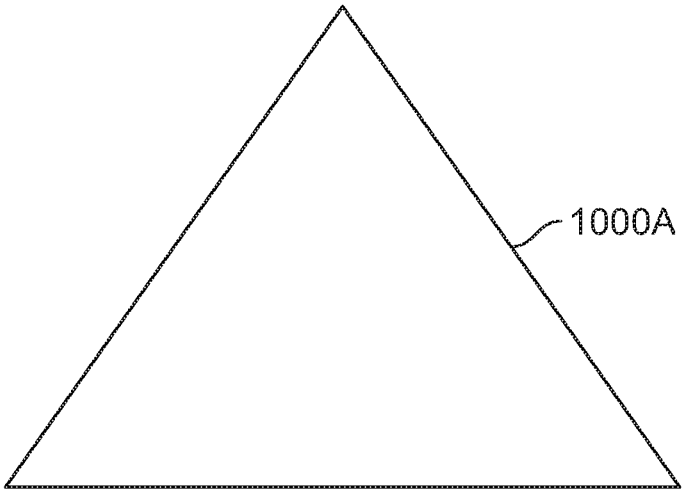
FIG. 10A is a side view of a conductor having a triangular cross section according to another example embodiment.
Figure 10B:
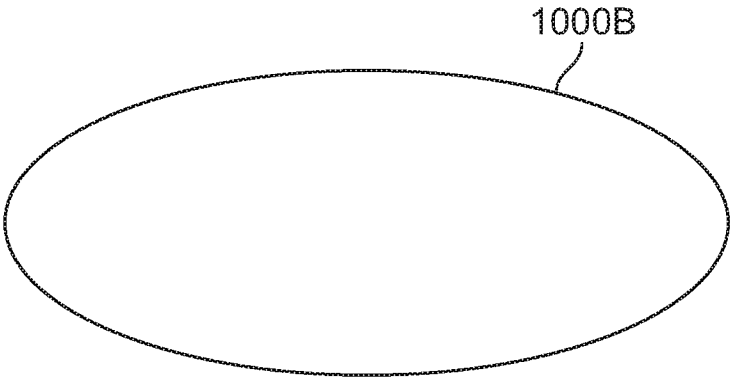
FIG. 10B is a side view of a conductor having an oval cross section according to yet another example embodiment.

In some embodiments, the coils disclosed herein may have a substantially rectangular cross section as shown in FIGS. 2-5. In other embodiments, the conductors may have another suitable cross section such as a substantially oval cross section, a substantially triangular cross section, etc. For example, FIG. 10A illustrates a conductor 1000A having a triangular cross section and FIG. 10B illustrates a conductor 1000B having an oval cross section.

As explained above, the coils can be formed without employing conventional methods (e.g., stamping, photochemical etching, etc.) which typically produce large amounts of wasted material. Sometimes, as much as 87% of material is wasted using the conventional methods. As such, the coils can be produced with less waste material than conventional methods. Additionally, and as explained above, the coils can be formed with reduced (and sometimes no) sharp edges compared to coils produced by conventional methods.

Further, employing the coils in inductive components may reduce losses in the inductive components. For example, the coils can reduce and sometimes eliminate the need for inter-connects between turns of the coils, between adjacent coils, and between the coils and a circuit board. This may be due to, for example, employing a continuous conductor when forming the coils, employing substantially flat elongated conductors (e.g., rectangular cross section conductors, etc.) when forming the coils, etc. The reduction of interconnects may result in improved thermal characteristics of the coils, efficiency of the inductive components employing the coils, etc. In some examples, the coils may experience a four percent improvement in thermal characteristics compared to known coils.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A method of forming a coil for an inductive component, the method comprising:

providing a substantially flat, elongated and straight conductor;

bending the substantially flat, elongated and straight conductor into a figure 8 configuration without stamping or photochemical etching the conductor, the figure 8 configuration having opposite first and second ends, a first substantially rounded portion, and a second substantially rounded portion, each of the first and second substantially rounded portions terminating at one of the first and second ends; and folding the figure 8 configuration so the first substantially rounded portion overlies the second substantially rounded portion.

2. The method of claim 1 wherein folding includes folding the figure 8 configuration so that the first and second ends are located on opposite sides of the coil.

3. The method of claim 1 wherein the conductor is continuous.

4. The method of claim 1 further comprising bending at least one of the first and second ends.

5. The method of claim 4 wherein bending the at least one of the first and second ends includes bending the at least one of the first and second ends before bending the conductor into the figure 8 configuration.

6. The method of claim 1 further comprising substantially covering the conductor with an insulative material.

7. The method of claim 6 wherein substantially covering the conductor includes substantially covering the conductor with the insulative material before bending the conductor into the figure 8 configuration.

8. The method of claim 1 wherein the bending step and the folding step are automated.

9. The method of claim 1 wherein folding the figure 8 configuration includes folding the figure 8 configuration so the first and second ends of the figure 8 configuration extend in substantially parallel planes.

10. The method of claim 1 wherein the bending step and the folding step forms a coil having at least two turns.

11. The method of claim 1 wherein folding includes folding the figure 8 configuration to create a gap between the first substantially rounded portion and the second substantially rounded portion for receiving another coil.

12. The method of claim 1 wherein the inductive component includes an interleaved transformer and the coil includes at least one coil of the interleaved transformer.

13. The method of claim 12 wherein the coil includes a secondary winding of the interleaved transformer.

14. The method of claim 1 wherein bending the conductor into the figure 8 configuration includes bending the conductor into the figure 8 configuration so that the conductor forms a portion extending diagonally between the first substantially rounded portion and the second substantially rounded portion.

* * * * *